US010427120B2

(12) United States Patent
Zannoni

(10) Patent No.: US 10,427,120 B2
(45) Date of Patent: Oct. 1, 2019

(54) METHOD FOR AUTOMATIC SPEED CONTROL OF AN ORBITAL SHAKER DEVICE TO DETERMINE ONE OF MORE STACKED OUT OF BALANCE ORBITAL SHAKER DEVICES

(71) Applicant: Richard Zannoni, Becket, MA (US)

(72) Inventor: Richard Zannoni, Becket, MA (US)

(73) Assignee: EPPENDORF AG, Hamburg (DE)

( * ) Notice: Subject to any disclaimer, the term of this patent is extended or adjusted under 35 U.S.C. 154(b) by 265 days.

(21) Appl. No.: 15/298,356

(22) Filed: Oct. 20, 2016

(65) Prior Publication Data

US 2018/0111102 A1 Apr. 26, 2018

(51) Int. Cl.

*B01F 11/00* (2006.01)
*B01F 13/10* (2006.01)
*B01F 15/00* (2006.01)

(52) U.S. Cl.

CPC .... *B01F 15/00201* (2013.01); *B01F 11/0014* (2013.01); *B01F 13/1022* (2013.01); *B01F 15/00207* (2013.01); *B01F 15/00253* (2013.01); *B01F 15/00285* (2013.01); *B01F 15/00376* (2013.01); *B01F 15/00389* (2013.01)

(58) Field of Classification Search

CPC ..... B01F 13/1013; B01F 11/0014
USPC ..... 366/110, 214
See application file for complete search history.

(56) References Cited

U.S. PATENT DOCUMENTS 8,016,478 B2 * 9/2011 Ebers ..... B01F 9/0021 366/208
8,226,291 B2 * 7/2012 Zamirowski ..... B01F 11/0014 366/111
8,534,905 B2 * 9/2013 Zamirowski ..... B06B 1/167 366/111
2008/0056059 A1 * 3/2008 Manera ..... B01F 11/0008 366/110
2011/0286298 A1 * 11/2011 Zamirowski ..... B01F 11/0014 366/111
2012/0294107 A1 * 11/2012 Zamirowski ..... B01F 11/0014 366/110
2015/0375145 A1 * 12/2015 Sherwood ..... B07B 11/04 210/780

* cited by examiner

*Primary Examiner* — David L Sorkin
(74) *Attorney, Agent, or Firm* — Grogan, Tuccillo & Vanderleeden, LLP

(57) ABSTRACT

A method for automatic speed control of an orbital shaker device to determine one of at least two stacked orbital shaker devices operating in an out of balance condition includes the steps of a) Starting the first orbital shaker device, b) Accelerating the first orbital shaker device, and c) Determining a vibration level of the first orbital shaker device, and d) Automatically decreasing a speed of the first orbital shaker device if the vibration level determined in step c) exceeds a predefined first threshold, wherein the steps a) to d) are additionally executed for a second orbital shaker device independently from the first orbital shaker device.

14 Claims, 4 Drawing Sheets

Figure 1:
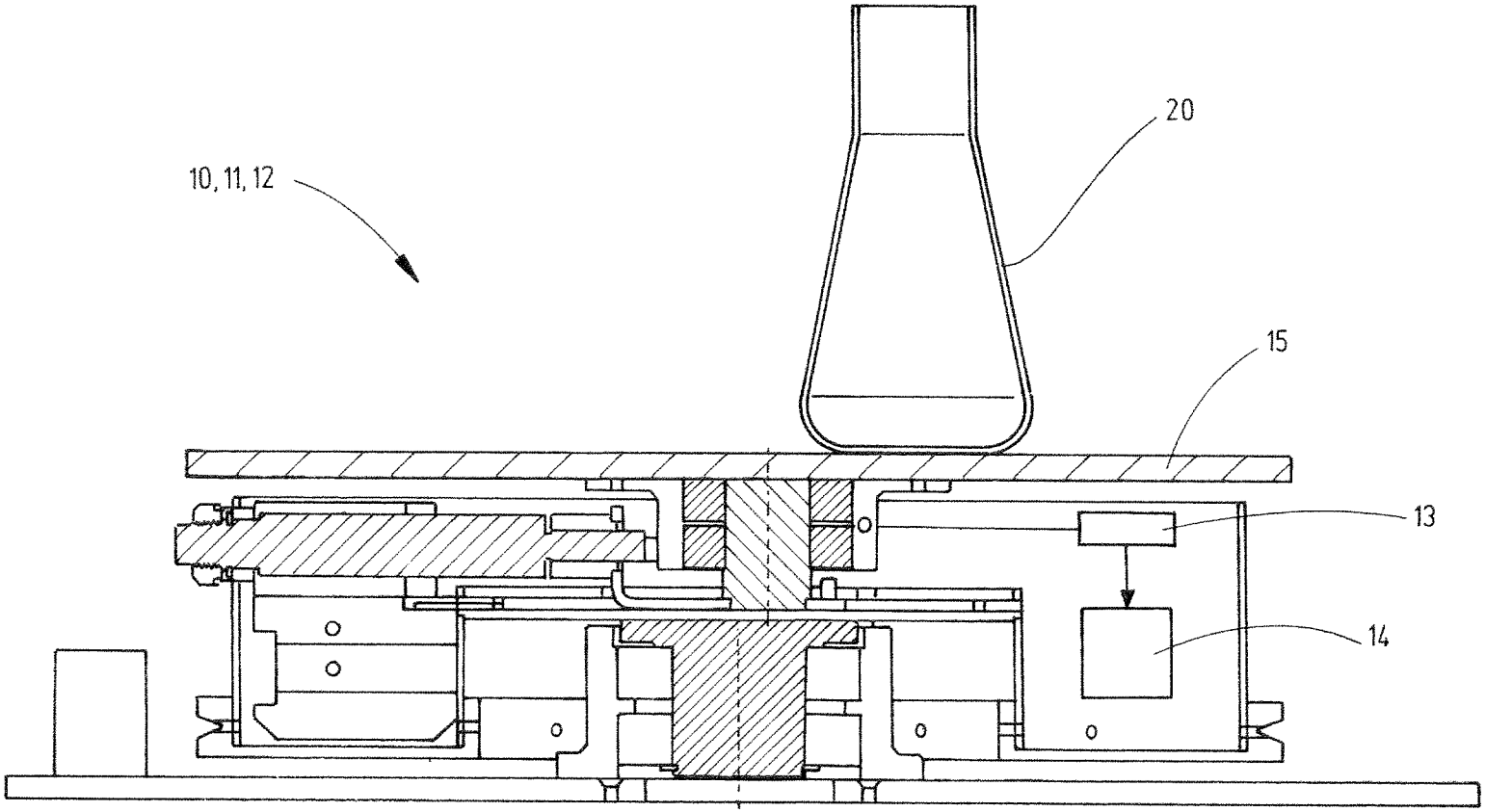

METHOD FOR AUTOMATIC SPEED CONTROL OF AN ORBITAL SHAKER DEVICE TO DETERMINE ONE OF MORE STACKED OUT OF BALANCE ORBITAL SHAKER DEVICES

TECHNICAL FIELD

The invention relates to a method for automatic speed control of an orbital shaker device to determine one of at least two stacked orbital shaker devices operating in an out of balance condition.

The present invention further relates to an orbital shaker device comprising an accelerometer to determine a vibration level of the orbital shaker device, the orbital shaker device further comprising a speed control unit for automatic speed control to determine one of at least two stacked orbital shaker devices operating in an out of balance condition.

Furthermore, the present invention relates to a multi-stack orbital shaker assembly comprising at least two orbital shaker devices in a stacked configuration, wherein each orbital shaker device comprises a separate accelerometer and a separate speed control unit to execute the automatic speed control method for determining the orbital shaker device operating in an out of balance condition.

DESCRIPTION OF THE RELATED ART

An orbital shaker device is a mixing or stirring device used especially in scientific applications for mixing or stirring containers, such as beakers and flasks holding various liquids on a platform. Specifically, an orbital shaker device translates a platform in a manner such that all points on the upper surface, in the x-y plane, of the platform move in a circular path having a common radius. Generally, beakers, flasks, and other vessels are attached to the upper surface of the platform such that the liquid contained therein is swirled around the interior sidewalls of the vessel to increase mixing and increasing interaction or exchange between the liquid and local gaseous environment.

In operation, the forces resulting from the total orbitally-rotating mass can often cause undesired motion of the base of the orbital shaker device which can superimpose additional motion components into the liquid and the vessels and lead to undesirable turbulences or splashing.

In order to reduce this undesired motion, the mass of none-rotating supporting structure of the orbital shaker apparatus must be increased to resist the forces generated by the rotating mass. This leads to the undesirable effect of increasing the overall weight of the shaker device simply to address for stabilization. Alternatively, counterweights have been employed to oppose or compensate the forces generated from the orbitally-rotating mass.

EP 2 714 253 B1 for example discloses an orbital shaker device with an apparatus for reducing the instability generally caused by static imbalance between a counterweight and the load of flasks or other vessels on the platform. Furthermore, EP 2 714 253 B1 relates to an apparatus for varying the orbit diameter of the orbital shaker apparatus.

In a multi-stack orbital shaker assembly, the structures of the individual orbital shaker devices are mechanically connected. Therefore, an out of balance condition on one orbital shaker device will excite vibrations on other orbital shaker devices in the multi-stack assembly. This situation can cause constituent tripping of vibration threshold on in-balance orbital shaker devices in the stack.

DESCRIPTION OF THE INVENTION: OBJECTIVE, SOLUTION, ADVANTAGES

The present invention suggests a method for automatic speed control of an orbital shaker device to determine one of at least two stacked orbital shaker devices operating in an out of balance condition, without the need of any manual interaction to one of the orbital shaker devices.

The present invention therefore proposes a method for automatic speed control of an orbital shake device to determine one of at least two stacked orbital shaker devices operating in an out of balance condition, the method comprising the steps of:

starting the first orbital shaker device; and accelerating the first orbital shaker device; and determining a vibration level of the first orbital shaker device; and automatically decreasing a speed of the first orbital shaker device if the vibration level determined in step c) exceeds a predefined first threshold.

According to the present invention the steps a) to d) are additionally executed for at least a second orbital shaker device independently from the first orbital shaker device.

The present invention further proposes an orbital shaker device comprising an accelerometer to determine a vibration level of the orbital shaker device, the orbital shaker device further comprising a speed control unit for automatic speed control according to a method to determine one of at least two stacked orbital shaker devices.

The present invention further proposes a multi-stack orbital shaker assembly comprising at least two orbital shaker devices arranged in a stacked configuration, wherein each orbital shaker device comprises a separate accelerometer and a separate speed control unit to execute an automatic speed control method for determining one orbital shaker device of the multi-stack assembly operating in an out of balance condition.

BRIEF DESCRIPTIONS OF THE DRAWINGS

In the following, the present invention is being described based on preferred embodiments of the invention.

Figure 2:
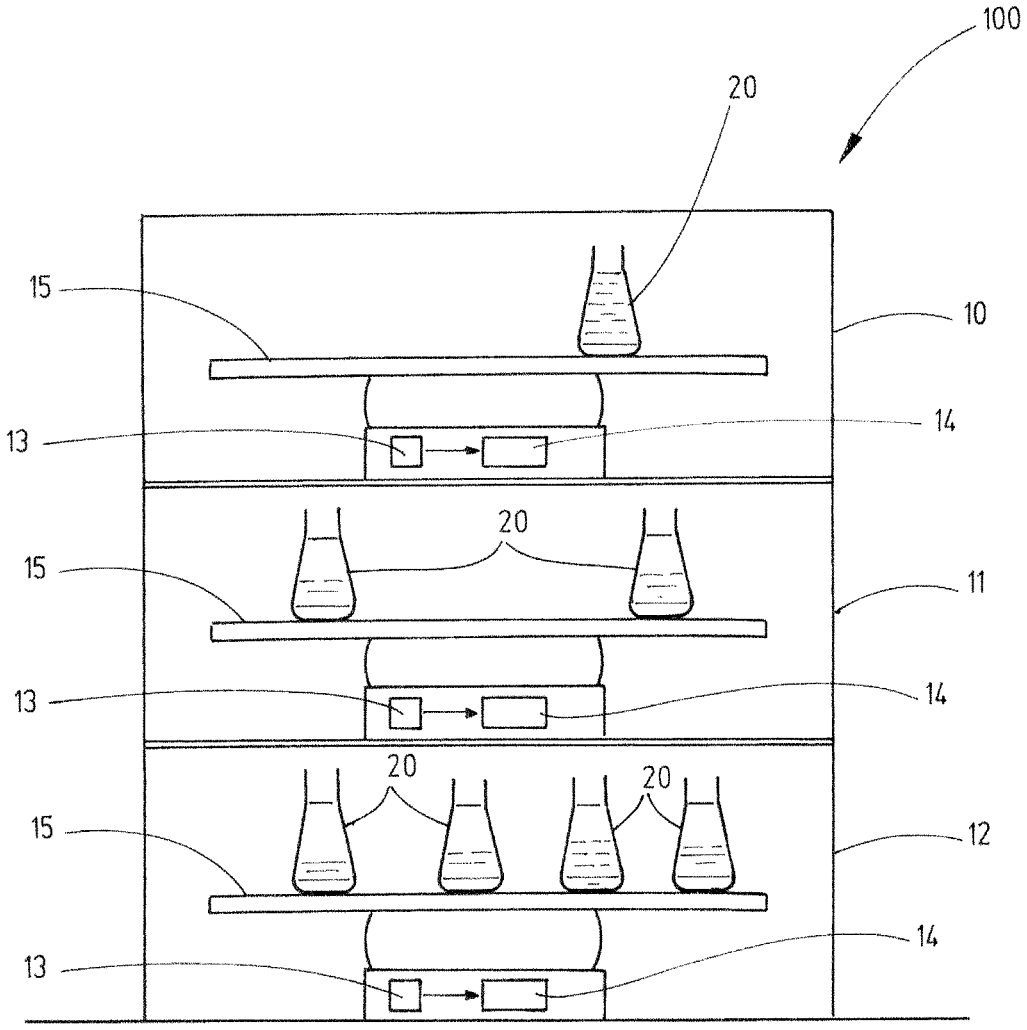
Figure 3:
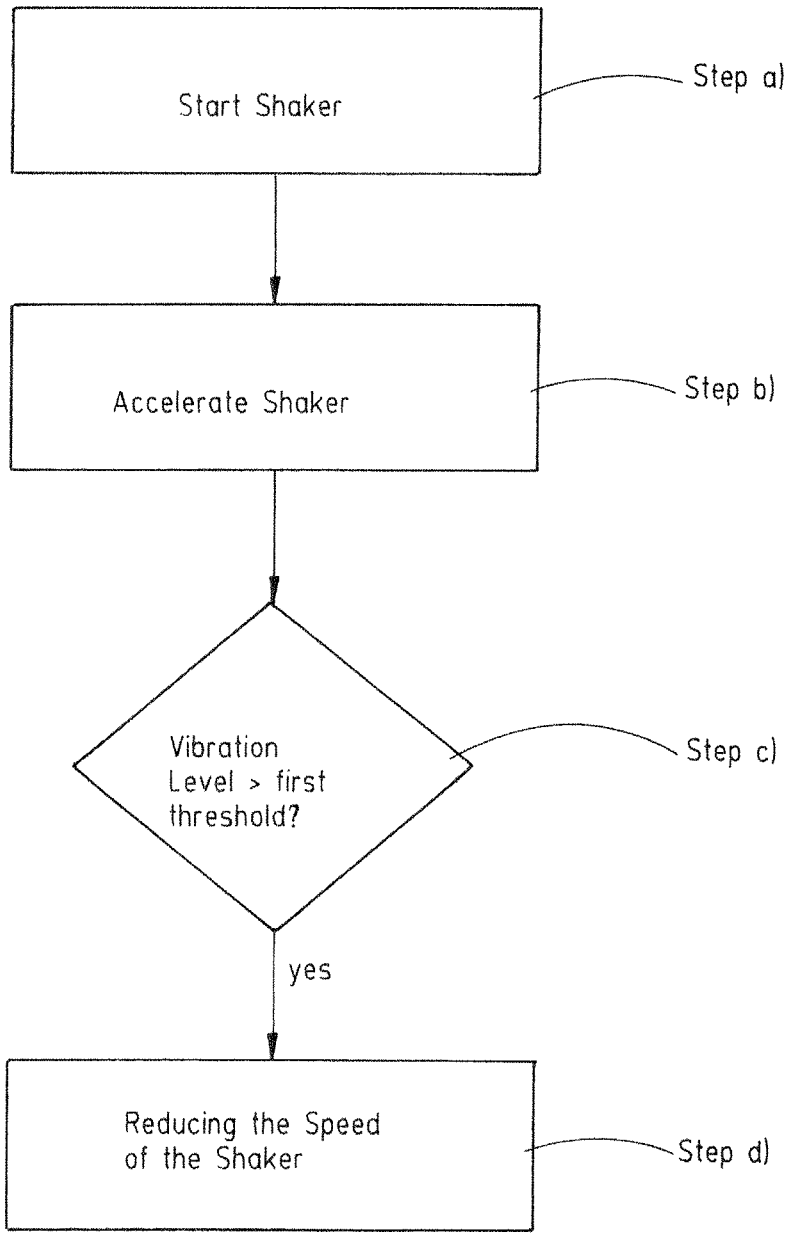
Figure 4:
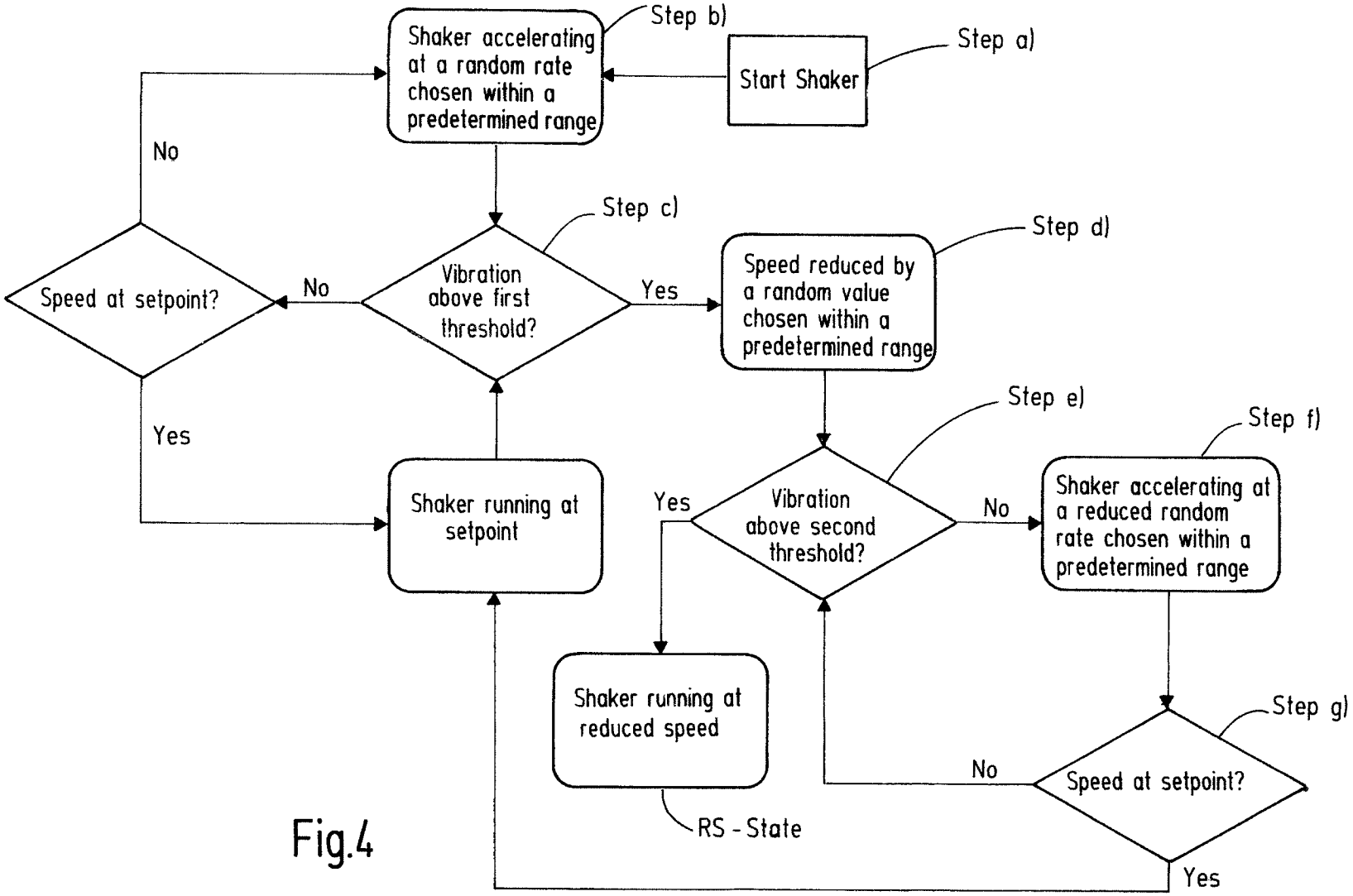

FIG. 1: shows an orbital shaker device;

FIG. 2: shows a multi-stack orbital shaker assembly with three stacked orbital shaker devices;

FIG. 3: shows a flowchart with the basic method steps of an automatic speed control method to determine one of at least two stacked orbital shaker devices; and FIG. 4: shows a flowchart of a preferred automatic speed control method to determine one of at least two stacked orbital shaker devices.

All method steps of the automatic speed control method can be executed on different orbital shaker devices arranged in a stacked relation in parallel and in particular independently from each other on each orbital shaker device. For example, in step b) orbital shaker devices are not necessarily accelerated at the same pace. Furthermore, in step d), the speed is not necessarily decreased at the same pace on each orbital shaker device.

In a multi-stack orbital shaker assembly multiple orbital shaker devices are arranged in a stacked configuration. Therefore, the orbital shaker devices stacked on each other are mechanically connected to each other. Vibration of one orbital shaker device will excite and influence the vibration of the other orbital shaker devices. An out of balance condition of one orbital shaker device will excite vibration of the other orbital shaker device. Therefore, it is difficult to determine the source orbital shaker device operating in the out of balance condition. Usually, a user would have to turn of manually one orbital shaker device after the other to determine the source orbital shaker device causing the out of balance condition. Alternatively, a user could manually decrease the target speed of the individual orbital shaker devices after each other trying to identify the source orbital shaker device causing the out of balance condition.

The present invention, however, proposes a speed control method which can run on the individual orbital shaker devices of a multi-stack shaker assembly to determine the source orbital shaker device causing the out of balance condition without the need of any interaction of a user. A user does not need to turn off orbital shaker devices. Furthermore, the user does not need to modify or decrease the target speed of any orbital shaker device manually to determine the source orbital shaker device causing the out of balance condition. Thus the present invention enables the smooth running of a stacked shaker assembly without the need of user interference.

This is reached by automatically increasing the speed in step b) of an orbital shaker device independently from the acceleration of another orbital shaker device in the stack. In a next step, the vibration level of the orbital shaker devices is determined independently from each other. The vibration level of each respective orbital shaker device is determined using an accelerometer. Therefore, each orbital shaker device may comprise a separate accelerometer. The method itself for detecting the vibration level can be based on a commonly known technique. More particularly, acceleration data can be sampled in the time-domain. Next, this time sampled data can be mapped to an angle domain. For example, the time sampled data can be mapped to drive wheel angle sampled acceleration data. In the following, the angle sampled data can be mapped to the frequency domain by applying a Fourier Transformation. Finally, from the frequency domain a component with a period of 360° can be selected and averaged to generate the vibration level.

In step d), the speed of an orbital shaker device is automatically decreased if the vibration level determined in step c) exceeds a predefined first threshold. The same happens with any other orbital shaker device in the stack in parallel and independently from the first orbital shaker device. In particular, the speed of each orbital shaker device can be decreased by a different value. Therefore, the speed of the orbital shaker devices in the stack will be decreased differently and not synchronously at the same pace. This will result in a condition where the source orbital shaker device causing the out of balance condition can be determined.

The steps a) to d) of the automatic speed control method can additionally be executed on a third orbital shaker device independently from the first orbital shaker device and/or the second orbital shaker device. All method steps can be independently executed on each orbital shaker device arranged in a stacked relation. In particular, there is no electrical and/or logical communication between the different orbital shaker devices. The method is operated on each orbital shaker device independently.

In step b) the first orbital shaker device and/or the second orbital shaker device and/or a third orbital shaker device is accelerated at a random rate chosen within a predetermined range. All shakers can be accelerated at a random rate independently from each other. This means, all orbital shaker devices can be accelerated at different rates and therefore not synchronously. To determine the random rate a random generator can be used. Each time, a random rate is required for accelerating the orbital shaker device, the random rate is determined by the random generator. Since the method steps are executed independently on each orbital shaker device, the random rate for accelerating the according orbital shaker device will be determined by the method on each orbital shaker device separately resulting in different random rates for the acceleration. The predetermined range can be between 10 and 100 RPM. More preferably the predetermined range can be between 20 and 80 RPM. Even more preferably, the predetermined range can be between 25 and 75 RPM.

In step b), the speed can be reduced by a random value chosen within the predetermined range. For generating the random value to decrease the speed, the same random value generator can be used as in step b) for the acceleration. The speed of all shakers arranged in the stacked configuration is reduced by a random value independently from each other resulting in different random values. The predetermined range for the random value to reduce the speed in step d) can be the same predetermined range as used for accelerating the orbital shaker devices in step b).

The automatic speed control method can further comprise the steps of:

determining the vibration level of the first orbital shaker device after automatically decreasing the speed in step d); and automatically accelerating the first orbital shaker device if the vibration level determined in step e) does not exceed the predefined second threshold.

If during acceleration in step b) the vibration exceeds the first threshold limit, the speed will be reduced automatically in step d). If the vibration level measured again in step e) is still below a second threshold level, the according orbital shaker device can be accelerated again in step f). The steps e) and f) can be executed on the second and third orbital shaker device in parallel and independently from each other.

The according orbital shaker device can be accelerated at a reduced random rate chosen within a predetermined range in step f). Therefore, the same predetermined range can be used as for acceleration in step b) and speed decrease in step d). Furthermore, the reduced random rate used to accelerate the according orbital shaker device in step f) is smaller than the random rate used for acceleration in step b) and smaller than the random value used to decrease the speed in d).

Furthermore, the reduced random rate used for accelerating the according orbital shaker device in step f) can always be smaller than the random rate for accelerating in step b) and can always be smaller than the random value used to decrease the speed in step d). To ensure that the reduced random rate used in step f) is always smaller than the reduced random rate used in step b) and the reduced random value used in step d), an identical predetermined range can be used in all steps b), d) and f), wherein the reduced random rate is determined by multiplying a result obtained from the random generator with a predefined factor. The factor can be chosen such, to make sure that the resulting reduced random rate is always smaller than the random rate used in step b) and the random value used in step d). For example, the predefined factor can be less than 0.3. Preferably the predefined factor is smaller than 0.25. Even more preferably the predefined factor is about 0.2.

The first threshold can be larger than the second threshold. For example, the first threshold can be between 0.04 and 0.05 gRMS. Even more preferably, the first threshold is about 0.045 gRMS. The second threshold can be between 0.03 and 0.04 gRMS. Even more preferably the second threshold can be about 0.035 gRMS.

The method may further comprise the step of:

Determining whether the first orbital shaker device and/or the second orbital shaker device and/or the third orbital shaker device is running at a target speed set by the user. In the following, the target speed is also referred to as the setpoint. If the according orbital shaker device has reached the target speed set by the user, step c) can be repeated. This means, the speed will not be changed automatically unless the vibration level exceeds the first threshold once the according orbital shaker device is running as the target speed set by the user.

Steps e) and f) can be repeated if the first orbital shaker device and/or the second orbital shaker device and/or the third orbital shaker device is running at a speed below the target speed.

In step f) the automatic speed control method enters a reduced speed state if the vibration level determined in step e) exceeds the predefined second threshold, wherein the first orbital shaker device and/or the second orbital shaker device and/or the third orbital shaker device keeps running at a respective reduced speed while the vibration level does not exceed the second threshold. The reduced speed is considered as safety-speed or maximum possible speed without exceeding the second threshold.

If the speed was reduced in step d) or in step f), but the vibration level does still exceeds the second threshold, the according orbital shaker device is determined as the source orbital shaker device which was operating in the out of balance condition. The according orbital shaker device or the method running on the according orbital shaker device will stay in the reduced speed state until a user stops the orbital shaker device or reduces the target speed below the speed limit imposed by the second threshold.

The vibration level can continuously be determined and compared with the second threshold in the reduced speed state wherein the speed of the first orbital shaker device and/or the second orbital shaker device and/or the third orbital shaker device is automatically increased if the vibration level is below or drops below the second threshold. This makes sure to keep the reduced speed at a maximum possible speed of the according orbital shaker device which was operating in an out of balance condition. The speed of the respective orbital shaker device can be automatically increased by the random rate chosen within a predetermined range if the vibration level is below or drops below the second threshold.

Furthermore, in the reduced speed state, the vibration level can be continuously determined and compared with the first threshold, wherein the speed of the according orbital shaker device is automatically decreased if the vibration level exceeds the first threshold. This makes sure that the vibration level does not exceed the first threshold again to avoid that the according orbital shaker device is operating in an out of balance condition again. The speed of the respective orbital shaker device can be automatically decreased by the reduced random rate if the vibration level exceeds the first threshold.

PREFERRED EMBODIMENT OF THE INVENTION

FIG. 1 shows a simplified structure of an orbital shaker device with a vessel 20 on a rotating platform 15 of the orbital shaker device 10, 11, 12. The orbital shaker device 10, 11, 12 comprises an accelerometer 13, such as an accelerator sensor, to determine the vibration level of the according orbital shaker device 10, 11, 12. The accelerometer 13 is sensitive to static and dynamic imbalances in three principle directions X, Y, Z. Furthermore, the orbital shaker device 10, 11, 12 comprises a speed control unit 14 for automatic speed control according to the predefined automatic speed control method. The accelerometer 13 is in electrical and/or logical communication with the speed control unit 14.

FIG. 2 shows a principal configuration of a multi-stack orbital shaker assembly 100 comprising of three stacked orbital shaker devices 10, 11, 12. Each orbital shaker device 10, 11, 12 comprises a separate accelerometer 13 and a separate speed control unit 14. This allows that on each orbital shaker device 10, 11, 12 an automatic speed control method can be executed independently and in parallel to determine the source orbital shaker device 10, 11, 12 operating in an out of balance condition.

FIG. 3 shows a simplified flowchart of the basic method steps for the automatic speed control running on an orbital shaker device 10, 11, 12. The basic method comprises the steps of step a: starting an orbital shaker device 10, 11, 12; and step b: accelerating the orbital shaker device 10, 11, 12; and step c: determining a vibration level of the according orbital shaker device 10, 11, 12; and step d: automatically decreasing a speed of the according orbital shaker device 10, 11, 12 if the vibration level determined in step c) exceeds a predefined first threshold.

The above described method, comprising these method steps a) to d), is executed independently on each of the orbital shaker devices 10, 11, 12.

FIG. 4 shows a flowchart with the steps of a preferred automatic speed control method. As in FIG. 3, this method shown in FIG. 4 can be executed independently on each of the orbital shaker devices 10, 11, 12. The preferred method shown in the flowchart of FIG. 4 comprises the steps of:

step a: starting the orbital shaker device 10, 11, 12; and step b: accelerating the according orbital shaker device 10, 11, 12 at a random rate chosen within a predefined range; and step c: determining a vibration level of the according orbital shaker device 10, 11, 12 and comparing this determined vibration level with a first threshold; and step d: automatically decreasing a speed of the according orbital shaker device 10, 11, 12 if the vibration level determined in step c) exceeds the predefined first threshold. The speed is automatically decreased by a random value chosen within a predetermined range; and step e: determining the vibration level of the according orbital shaker device 10, 11, 12 and comparing the determined vibration level with a second threshold; and step f: automatically accelerating the according orbital shaker device 10, 11, 12 at a reduced random rate chose within a predetermined range; and step g: determining the speed of the according orbital shaker device 10, 11, 12 and comparing this determined speed with the target speed or in other words with the set point set by the user.

If the speed of the according orbital shaker device 10, 11, 12 has reached the target speed, determining the vibration level step e) is being repeated.

If the determined vibration level of an according orbital shaker device 10, 11, 12 is still above the second threshold after reducing the speed in step d) and/or accelerating the speed in step f), the method is entering a reduced speed state RS-state. In the reduced speed state RS-state the according orbital shaker device 10, 11, 12 is identified as the source orbital shaker device which was originally operating in the out of balance condition. In the reduced speed state RS-state, the according orbital shaker device 10, 11, 12 will continue to run at the maximum possible speed that does not exceed the vibration level set by the second threshold. The method will continue in this reduced speed state RS-state for the according orbital shaker device 10, 11, 12 until the user stops the according orbital shaker device 10, 11, 12 or reduces the target speed for the according orbital shaker device 10, 11, 12 below the speed limit imposed by the second threshold. Within the reduced speed state RS-state, the vibration level will continuously be determined and compared with the first threshold and the second threshold. Once the vibration level drops below the second threshold, the speed will be increased for the according orbital shaker device 10, 11, 12. Once the vibration level exceeds the first threshold, the speed will automatically be reduced for the according orbital shaker device 10, 11, 12.

REFERENCE SIGNS

100 Multi-stack orbital shaker assembly
10 First orbital shaker device
11 Second orbital shaker device
12 Third orbital shaker device
13 Accelerometer
14 Speed control unit
15 Platform
20 Vessel
RS-State Reduced Speed State
Step a) Starting an orbital Shaker Device
Step b) Accelerating the orbital Shaker Device
Step c) Determining a vibration level of the orbital Shaker Device
Step d) Automatically decreasing a speed of the orbital Shaker Device
Step e) Determining the vibration level of the orbital Shaker Device
Step f) Automatically accelerating the orbital Shaker Device

The invention claimed is:

1. Method for automatic speed control of an orbital shaker device (10, 11, 12) to determine one of at least two stacked orbital shaker devices (10, 11, 12) operating in an out of balance condition, the method comprising the steps of:

a) Starting the first orbital shaker device (10); and b) Accelerating the first orbital shaker device (10); and c) Determining a vibration level of the first orbital shaker device (10); and d) Automatically decreasing a speed of the first orbital shaker device (10) if the vibration level determined in step c) exceeds a predefined first threshold;

wherein the steps a) to d) are additionally executed for a second orbital shaker device (11) independently from the first orbital shaker device (10);

wherein the speeds of the orbital shaker devices are increased and/or decreased at different rates and thus not synchronously, such that the speed of the orbital shaker devices differs and the source orbital shaker device causing the out of balance condition can be determined.

2. Method according to claim 1, wherein the steps a) to d) are additionally executed for a third orbital shaker device (12) independently from the first orbital shaker device (10) and/or the second orbital shaker device (11).

3. Method according to claim 1, wherein in step b) the first orbital shaker device (10) and/or the second orbital shaker device (11) and/or a third orbital shaker device (12) is accelerated at a random rate chosen within a predetermined range.

4. Method according to claim 1, wherein in step d) the speed is decreased by a random value chosen within a predetermined range.

5. Method according to claim 1, wherein the method further comprises the steps of:

e) Determining the vibration level of the first orbital shaker device (10) after automatically decreasing the speed in step d); and f) Automatically accelerating the first orbital shaker device (10) if the vibration level determined in step e) does not exceed a predefined second threshold.

6. Method according to claim 5, wherein in step f) the first orbital shaker device (10) and/or the second orbital shaker device (11) and/or a third orbital shaker device (12) is accelerated at a reduced random rate chosen within a predetermined range.

7. Method according to claim 6, wherein in step b) the first orbital shaker device (10) and/or the second orbital shaker device (11) and/or the third orbital shaker device (12) is accelerated at a random rate chosen within a predetermined range;

wherein in step d) the speed is decreased by a random value chosen within a predetermined range; and wherein the reduced random rate of claim 6 is always smaller than the random rate in step b) and smaller than the random value in step d).

8. Method according to claim 7, wherein in steps b) and/or d) and f) identical random generators and predetermined ranges are applied, wherein the reduced random rate for step f) is determined by multiplying a result obtained from the random generator with a predefined factor.

9. Method according to claim 5, wherein the first threshold is larger than the second threshold.

10. Method according to claim 5, wherein the method further comprises the step of:

g) Determining whether the first orbital shaker device (10) and/or the second orbital shaker device (11) and/or a third orbital shaker device (12) is running at a target speed set by a user.

11. Method according to claim 10, wherein steps e) and f) are repeated if the first orbital shaker device (10) and/or the second orbital shaker device (11) and the third orbital shaker device (12) is running at a speed below the target speed.

12. Method according to claim 5, wherein in step f) the automatic speed control method enters a reduced speed state if the vibration level determined in step e) exceeds the predefined second threshold, wherein the first orbital shaker device (10) and/or the second orbital shaker device (11) and/or a third orbital shaker device (12) keeps running at a respective reduced speed while the vibration level does not exceed the second threshold.

13. Method according to claim 12, wherein in the reduced speed state, the vibration level is continuously determined and compared with the second threshold, wherein the speed of the first orbital shaker device (10) and the second orbital shaker device (11) and the third orbital shaker device (12) is automatically increased if the vibration level is below the second threshold.

14. Method according to claim 12, wherein in the reduced speed state, the vibration level is continuously determined and compared with the first threshold, wherein the speed of the first orbital shaker device (10) and/or the second orbital shaker device (11) and/or the third orbital shaker device (12) is automatically decreased if the vibration level exceeds the first threshold.

* * * * *